US007116304B2

(12) United States Patent
Niimura et al.

(10) Patent No.: US 7,116,304 B2
(45) Date of Patent: Oct. 3, 2006

(54) LIQUID CRYSTAL DISPLAY APPARATUS

(75) Inventors: Minoru Niimura, Musashino (JP); Takashi Kimura, Shiojiri (JP); Katsumi Tsukada, Ina (JP); Hirotsuna Miura, Fujimi-machi (JP)

(73) Assignee: Seiko Epson Corporation, (JP)

( * ) Notice: Subject to any disclaimer, the term of this patent is extended or adjusted under 35 U.S.C. 154(b) by 473 days.

(21) Appl. No.: 10/124,628

(22) Filed: Apr. 17, 2002

(65) Prior Publication Data

US 2002/0154130 A1 Oct. 24, 2002

(30) Foreign Application Priority Data

Apr. 18, 2001 (JP) ..... 2001-120222

(51) Int. Cl.
*G09G 3/36* (2006.01)

(52) U.S. Cl. ..... 345/98; 345/542

(58) Field of Classification Search ..... 345/534, 345/545, 558, 98, 100, 564–566, 542, 204
See application file for complete search history.

(56) References Cited

U.S. PATENT DOCUMENTS 4,317,115 A * 2/1982 Kawakami et al. ..... 345/94
4,870,406 A * 9/1989 Gupta et al. ..... 345/506
5,036,317 A * 7/1991 Buzak ..... 345/74.1
5,673,416 A * 9/1997 Chee et al. ..... 345/535
6,067,098 A * 5/2000 Dye ..... 345/531
6,215,497 B1 * 4/2001 Leung ..... 345/419
6,657,634 B1 * 12/2003 Sinclair et al. ..... 345/534

FOREIGN PATENT DOCUMENTS

| | | |
|---|---|---|
| JP | 63-296093 | 12/1988 |
| JP | 06-130910 | 5/1994 |
| JP | 06-308908 | 11/1994 |
| JP | 07-261709 | 10/1995 |
| JP | 09-297562 | 11/1997 |
| JP | 2001-005632 | 1/2001 |

OTHER PUBLICATIONS

Communication from Japanese Patent Office regarding related application.

* cited by examiner

*Primary Examiner*—Richard Hjerpe
*Assistant Examiner*—Kevin M. Nguyen
(74) *Attorney, Agent, or Firm*—Harness, Dickey & Pierce, P.L.C.

(57) ABSTRACT

Display data read out from a picture display memory region within a UMA memory is written in a FIFO, and display data is transferred from the FIFO at a timing required by a liquid crystal panel, wherein a timing of reading out display data from the UMA region and a timing of transferring display data to the liquid crystal panel are made asynchronous to each other. Also, upon detection of writing in a display data region, display data for one picture frame is transferred to the liquid crystal panel, whereby the reduction in the bandwidth for CPU's memory accesses to the UMA is prevented, and the reduction in the overall power consumption of the display system is realized.

13 Claims, 18 Drawing Sheets

Liquid crystal display apparatus

When the refresh rate of the liquid crystal display is 50Hz, accesses to display data periodically occur at 20ms intervals. As a result, the CPU's access is divided into segments.

Liquid crystal display apparatus

Liquid crystal display apparatus

Display data for one frame is transferred in one lot to the driver. Then, data requests from FIFO are generated at a thinned out display refresh cycle, and display data for one frame is transferred in one lot.

Liquid crystal display apparatus

When the address comparator detects CPU's writing in a display data region of UMA, it notifies to the liquid crystal controller. Liquid crystal controller writes display data for one frame in FIFO to fit to the empty state of FIFO. FIFO transfers data in one lot to the line driver.

Liquid crystal display apparatus

Liquid crystal controller reads out display data for one frame from UMA memory by instruction from software, and writes data at a timing required by FIFO. FIFO transfers data in one lot to the driver.

Liquid crystal display apparatus

When FIFO comparator detects that the empty state of FIFO coincides with a programmed value, it notifies the same to the liquid crystal controller and the liquid crystal controller writes display data until FIFO is filled. FIFO transfers data in one lot to the line driver.

Liquid crystal display apparatus

When the address comparator detects CPU's writing in a display data region of UMA, the down counter stops subtraction, and returns to an initial value. When there is no detection of writing for a predetermined period of time, the down counter reaches 0, and stops the operation of the display clock.

Liquid crystal display apparatus

Liquid crystal display apparatus

When the address comparator detects CPU's writing in a display data region of UMA, it notifies the same to the liquid crystal controller. The liquid crystal controller, after a predetermined delay, reads out display data from a display data region of UMA, and writes the same in the line driving driver.

LIQUID CRYSTAL DISPLAY APPARATUS

BACKGROUND OF THE INVENTION

1. Technical Field of the Invention

The present invention relates to a liquid crystal display apparatus using a so-called unified memory architecture (UMA), which shares a display memory and a memory for storing execution code and data for a CPU. More particularly, the present invention relates to a liquid crystal display apparatus that adopts a UMA as a display memory of a device that transfers display data to the liquid crystal display panel.

2. Conventional Technology

There are some conventional liquid crystal display apparatuses that use a UMA structure as shown in FIG. 1, but they have to transfer display data in synchronism with refreshing of the liquid crystal display, and therefore occupy a band of the bus connected to the UMA memory to some degree. An arrow shown in FIG. 1 indicates a flow of data relating to display.

A CPU 1 uses a UMA memory 3 for executing a program and also as an area for storing display data. A liquid crystal controller 5 accesses the UMA memory 3 through a CPU interface 2 to read out display data, and transfers the same to a liquid crystal line driving driver 7. A liquid crystal panel 9 performs a display operation using the line driver 7 and a common driver 8.

In this instance, the liquid crystal controller 5 must write data in synchronism with a timing required by the line driver 7. For memory accesses for display, a memory bus 4 is used just as does the CPU and other bus masters. However, unless the display is given a first priority, the display flickers, and therefore the CPU and other bus masters are put in a standby state. Such timing is shown in FIG. 2.

A timing chart 20 indicates periods in which the CPU 1 can access the UMA memory 3. A timing chart 21 indicates timings in which the liquid crystal controller 5 makes periodical accesses to the UMA memory 3. When the liquid crystal display is refreshed at 50 Hz, accesses to the display data occurs at 20 nm intervals. As a result, the period in which the CPU 1 can access to the UMA memory 3 are divided into segments.

In other words, in a display apparatus using a conventional UMA memory, the bandwidth used by the CPU and other band masters is restricted, and the operation of an application in which frequent memory accesses are made, such as in a process of moving pictures, is often hindered.

It is an object of the present invention to reduce the influence of reduction of bandwidth of a memory bus, effectively perform a display operation and reduce the overall power consumption for the display operation.

SUMMARY OF THE INVENTION

To solve the problems described above, a liquid crystal display apparatus in accordance with the present invention is characterized in comprising: a liquid crystal display panel equipped with a common driving driver and a line driving driver; a device that transfers display data to the liquid crystal display panel; a semiconductor memory that retains data; and an interface device for a central processing unit, wherein the semiconductor memory retains execution code and data for a CPU and display data for the liquid crystal controller, and the liquid crystal controller has a FIFO with a depth of a plurality of words, writes display data read out from a picture display memory region in the UMA memory into the FIFO, and transfers display data from the FIFO at a timing required by the liquid crystal panel to thereby make a timing of reading out display data from the UMA region and a timing of transferring display data to the liquid crystal panel asynchronous to each other. As a result, a band for the UMA memory can be effectively used, and the overall power consumption for the display operation can be reduced.

Also, the present invention is characterized in that the line driving driver has a display data storage memory mounted thereon such that the liquid crystal panel can refresh display by itself to thereby suppress reduction of a bandwidth of a UMA memory bus.

Also, the present invention is characterized in that the liquid crystal controller has a FIFO of a depth of a plurality of words, detects that data in a picture display memory region set at the UMA region within the semiconductor memory can be rewritten, obtains display data from the semiconductor memory, writes the display data in the FIFO, and transfers the display data from the FIFO at a timing required by the liquid crystal panel, such that a timing for reading out display data from the UMA region and a timing for transferring display data to the liquid crystal panel are made asynchronous to each other.

Also, the present invention is characterized in that the liquid crystal controller has a FIFO of a depth of a plurality of words, and in response to an instruction of a software, obtains display data from the semiconductor memory, writes the display data in the FIFO, and transfers the display data from the FIFO at a timing required by the liquid crystal panel, such that a timing for reading out display data from the UMA region and a timing for transferring display data to the liquid crystal panel are made asynchronous to each other.

Also, the present invention is characterized in further comprising a device that monitors an empty condition of the FIFO of a depth of a plurality of words of the liquid crystal controller, and a register that programs a threshold value of the FIFO, wherein, when a value written in the register becomes a state that coincides with the empty condition of the FIFO, the liquid crystal controller reads out display data from the picture display memory region within the UMA memory and writes the same in the FIFO.

Also, the present invention is characterized in that, when rewriting of data in a picture display memory region set in the UMA region within the semiconductor memory does not occur for a predetermined period of time, an operation clock of the liquid crystal controller is stopped to set a low power consumption mode, while the display is continued.

Also, the present invention is characterized in that the display clock is resumed upon detention of an occurrence of writing of data in a picture display memory region set in the UMA region within the semiconductor memory.

Also, the present invention is characterized in that, when the apparatus in accordance with the present invention does not have a FIFO, and the line driving driver has a display data storage memory mounted thereon, the liquid crystal controller detects that data in a picture display memory region set in a UMA memory within the semiconductor memory can be rewritten, obtains display data from the semiconductor memory, and writes the display data in a memory of the line driving driver.

DETAILED DESCRIPTION OF THE PREFERRED EMBODIMENTS OF THE PRESENT INVENTION

Liquid crystal display apparatuses in accordance with the present invention will be described in detail with reference to the accompanying drawings.

Figure 1:
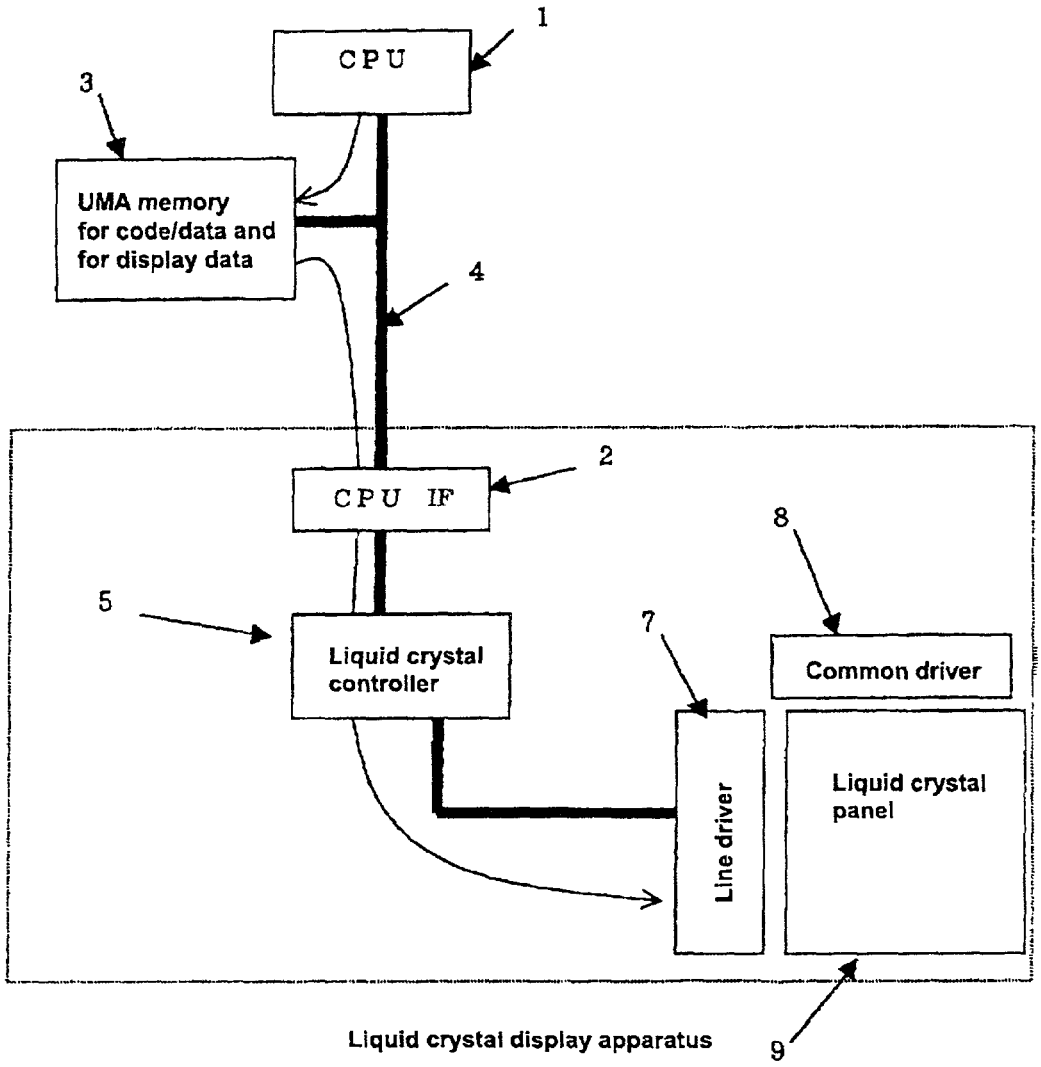
FIG. 1 is a diagram for describing a conventional technology.
Figure 2:
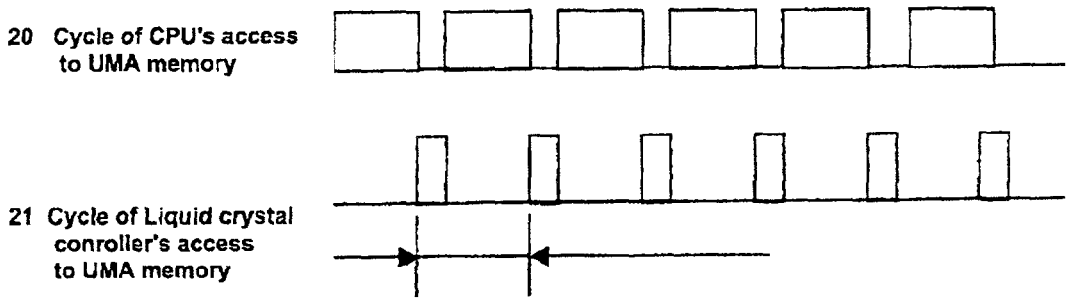
FIG. 2 is a chart indicating access timings to the UMA memory when the conventional technology is used.
Figure 3:
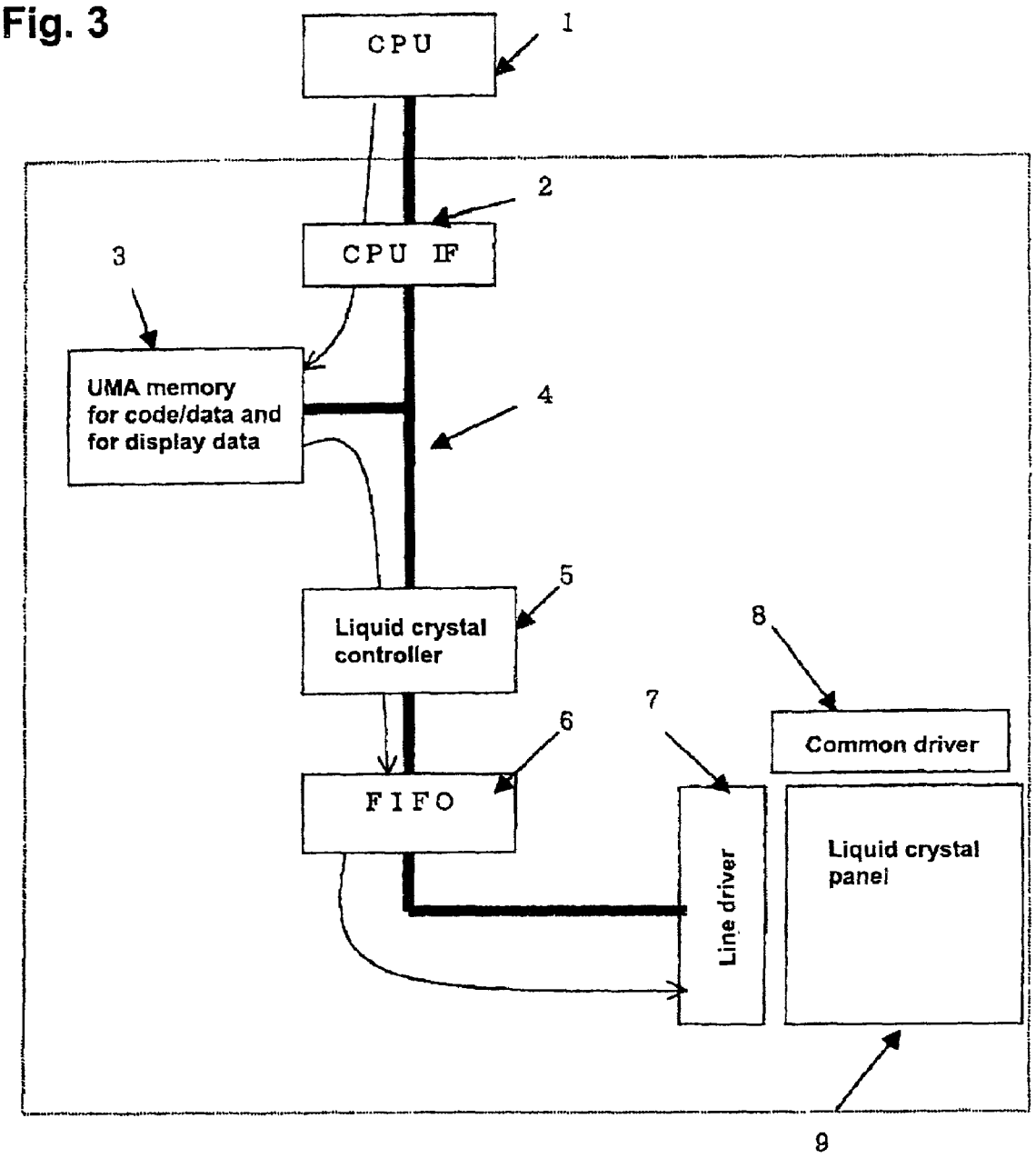
FIG. 3 is a diagram for describing a liquid crystal display apparatus.

FIG. 3 shows a structure of a liquid crystal display apparatus. In contrast to the conventional structure shown in FIG. 1, a FIFO 6 is added such that the read cycle of a liquid crystal controller 5 to a UMA memory 3 can be separated from the write timing thereof to a line driver 7.

Figure 4:
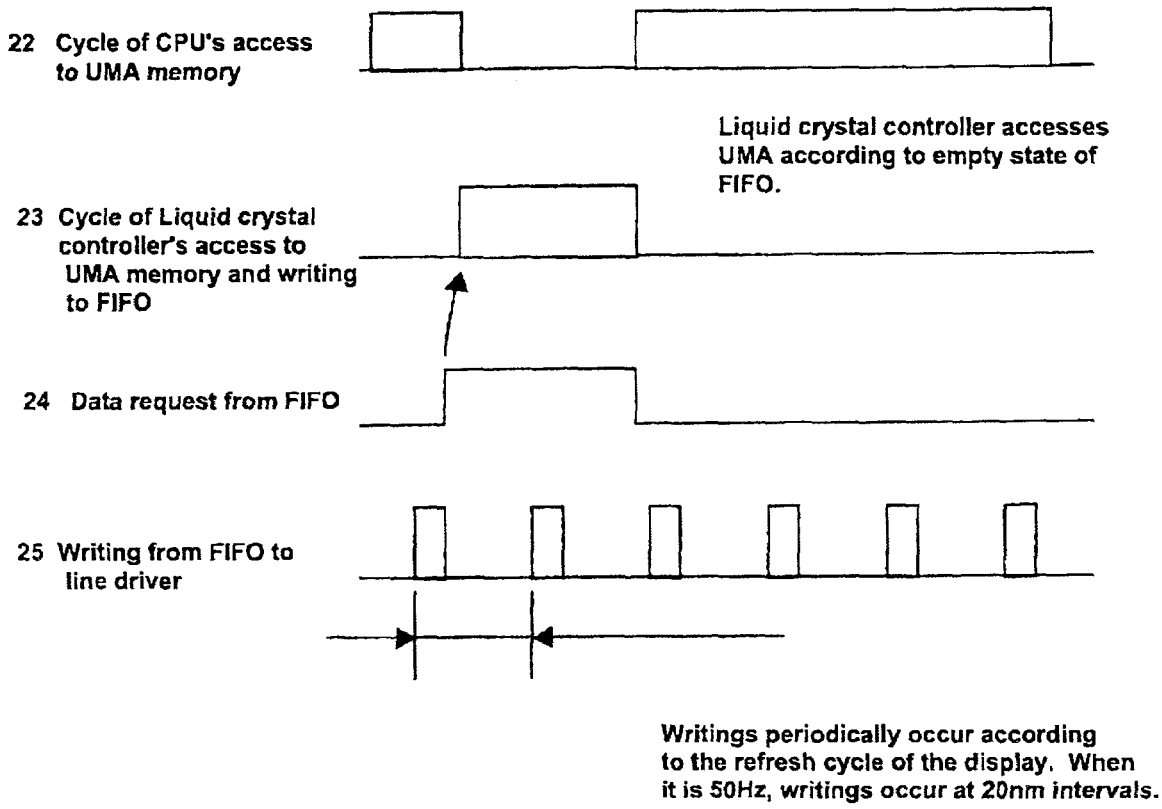
FIG. 4 is a chart indicating access timings to the UMA memory of the liquid crystal display apparatus.

FIG. 4 shows timing charts for describing an operation of the apparatus shown in FIG. 3. The FIFO 6 has a depth of a plurality of words, but when it is empty, it issues a data request to the liquid crystal controller 5 as indicated by a timing chart 24. In synchronism with the request, the liquid crystal controller 5 reads out data from the UMA memory 3, and writes the data in the line driver 7 as indicated by a timing chart 25. In other words, the liquid crystal controller can take in display data collectively for the depth of words of the FIFO, and therefore, chances of dividing memory accesses of the CPU are reduced, and the reduction in the memory band for the CPU can be reduced.

Figure 5:
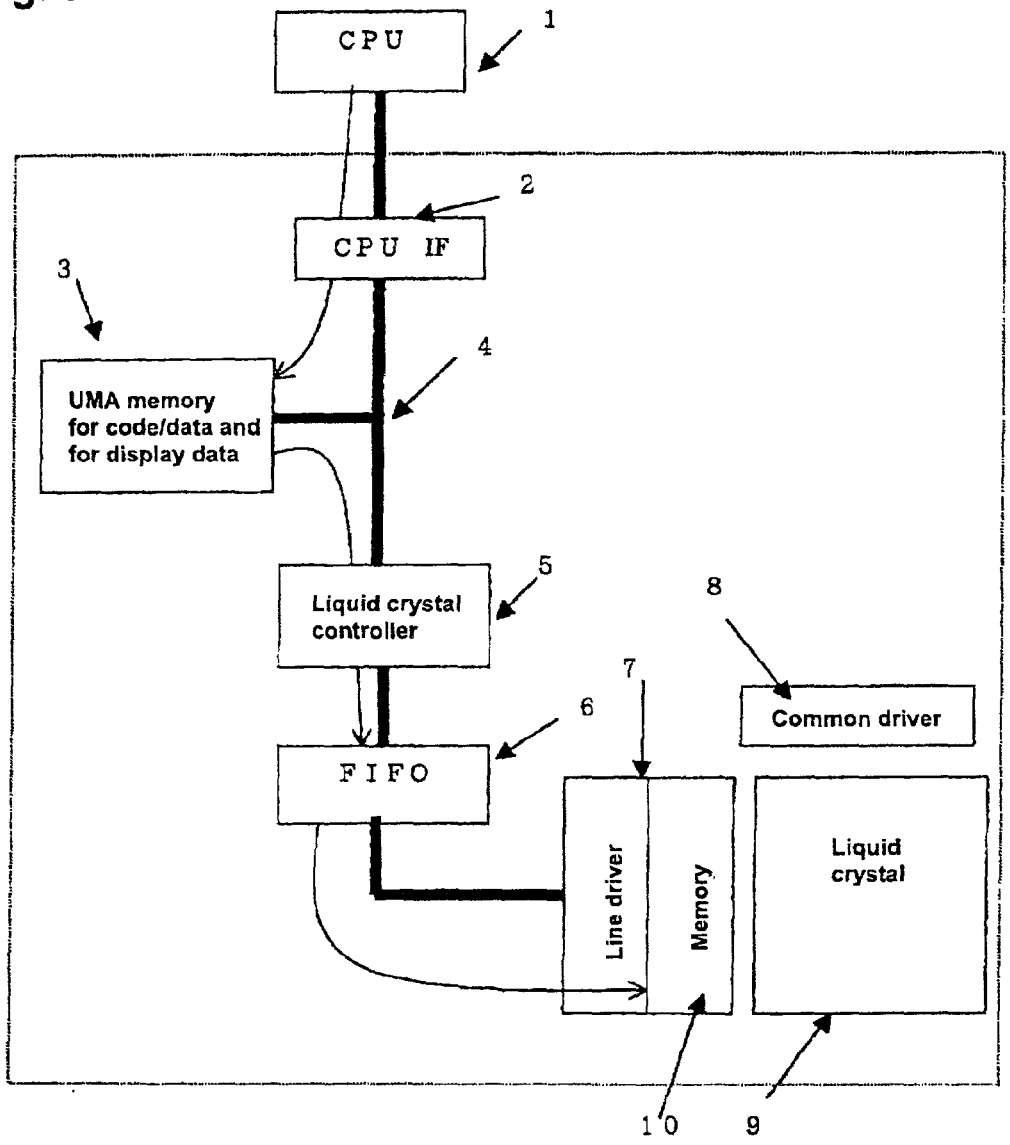
FIG. 5 is a diagram for describing a liquid crystal display apparatus.

FIG. 5 shows a structure of a liquid crystal display apparatus. A memory 10 is mounted on the line driver 7 of the apparatus shown in FIG. 3, such that the access frequency of the liquid crystal controller 5 to the UMA memory 3 can be further reduced.

Figure 6:
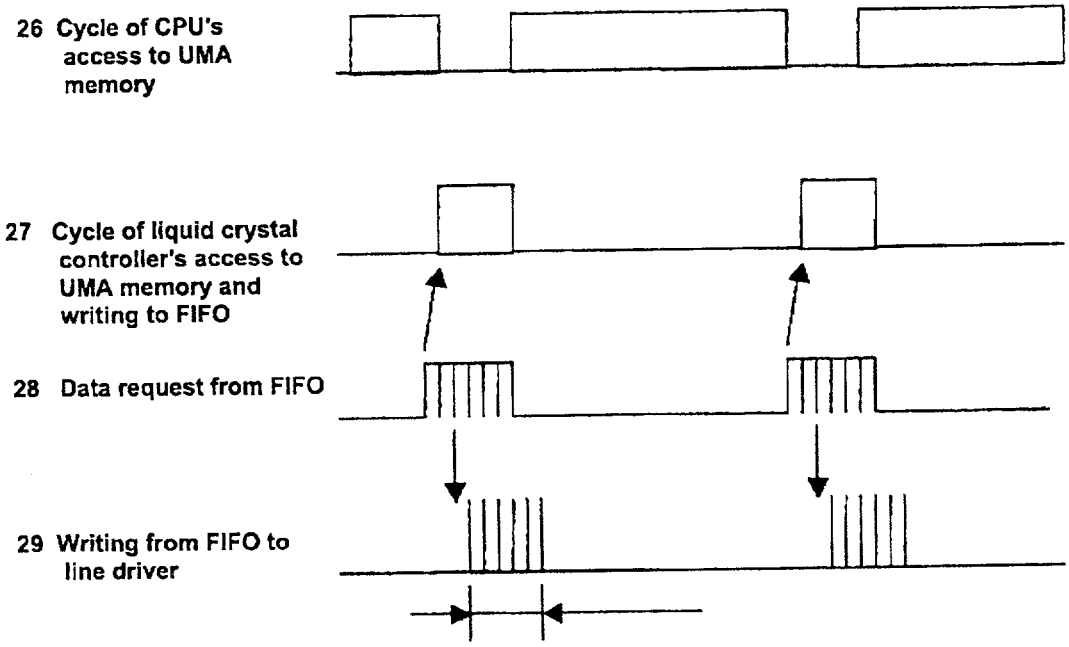
FIG. 6 is a chart indicating access timings to the UMA memory of the liquid crystal display apparatus.

FIG. 6 shows timing charts for describing an operation of the apparatus shown in FIG. 5. A liquid crystal panel 9 stores data required for display in the memory 10, and therefore can perform a refreshing operation by using the data. In other words, even when display data is taken in at a timing that is thinned out more than a refreshing cycle, flickers do not occur in the display. For example, in the case of a refreshing rate of 50 Hz, even when display data is fed in the liquid crystal panel at one quarter of the rate, which is 15 Hz, the display does not flicker. Timing charts 28 and 29 indicate that a data request from the FIFO 6 continues for a period of one frame of picture, display data for one frame of picture is sent to the memory 10 mounted on the line driver, and after a while, display data for one frame of picture is sent again. In other words, although the bandwidth of memory accesses by the CPU is restricted only during display memory accesses that occur like bursts, the rate of such restriction is substantially reduced because the refreshing of the liquid crystal can be thinned out.

Figure 7:
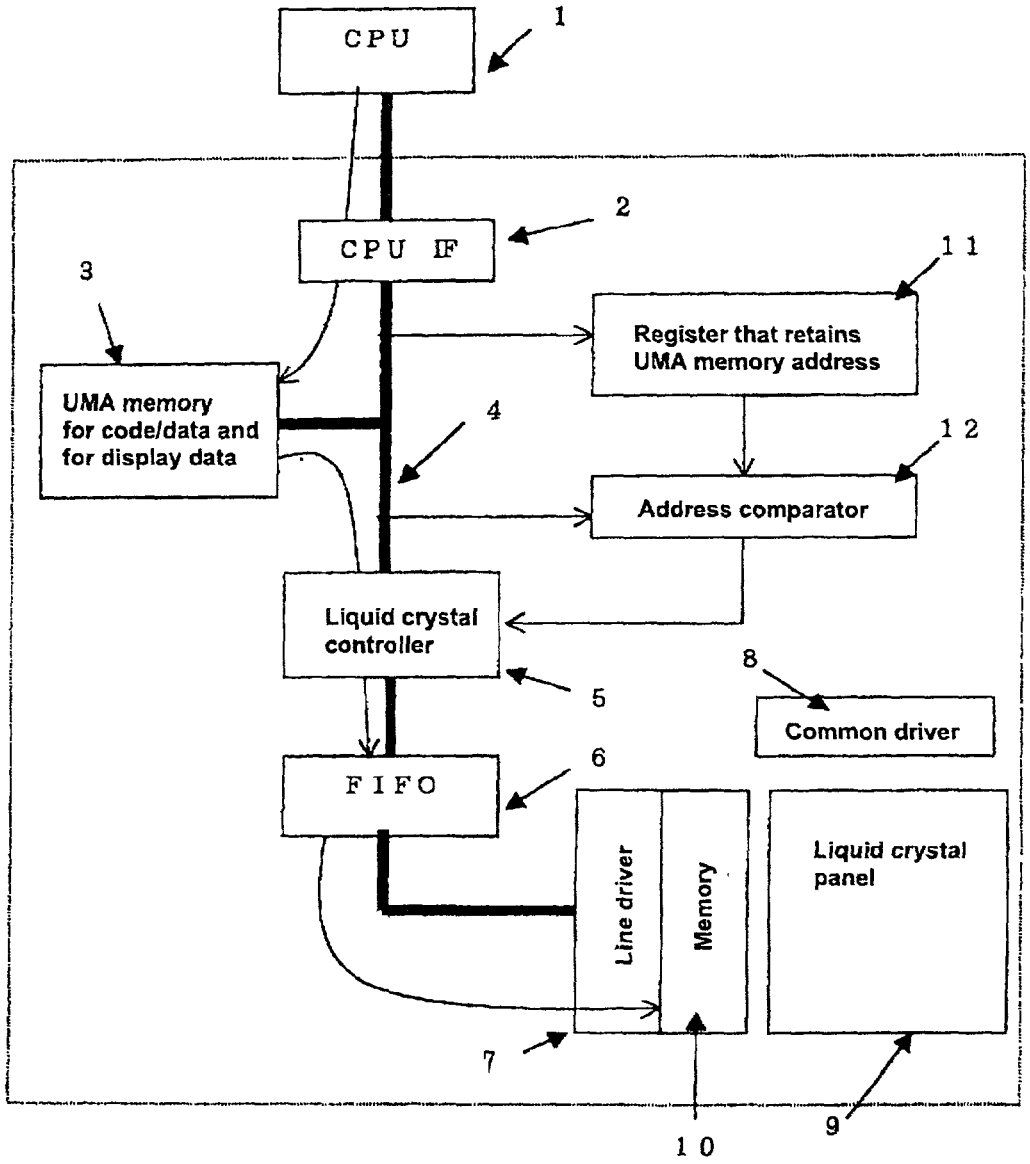
FIG. 7 is a diagram for describing a liquid crystal display apparatus.

FIG. 7 shows a structure of a liquid crystal display apparatus. In the liquid crystal display apparatus, the transfer of display data to the line driver is thinned out. However, if display data in a UMA memory region is renewed during the thinning out, there is a possibility that the renewal may not be reflected on the display. In order to eliminate such a possibility, the apparatus is additionally provided with a device that detects if the CPU 1 or another bus master rewrites data in a display data storage region of the UMA memory, a register 11 that retains a UMA memory address region, and an address comparator 12. In other words, the address comparator 12 compares an upper address of a memory write cycle that appears on the memory bus 4 with an address stored in the register 11, and outputs a signal to the liquid crystal controller 5 when they coincide with each other. The liquid crystal controller 5 reads out display data from the UMA memory 3, and writes the same in the memory 10 mounted on the line driver. However, since the FIFO 6 described above is placed between the liquid crystal controller 5 and the line driver 7, a read out timing of the liquid crystal controller 5 for reading out from the UMA memory 3 and a write timing thereof to the line driver 7 are made asynchronous to each other.

Figure 8:
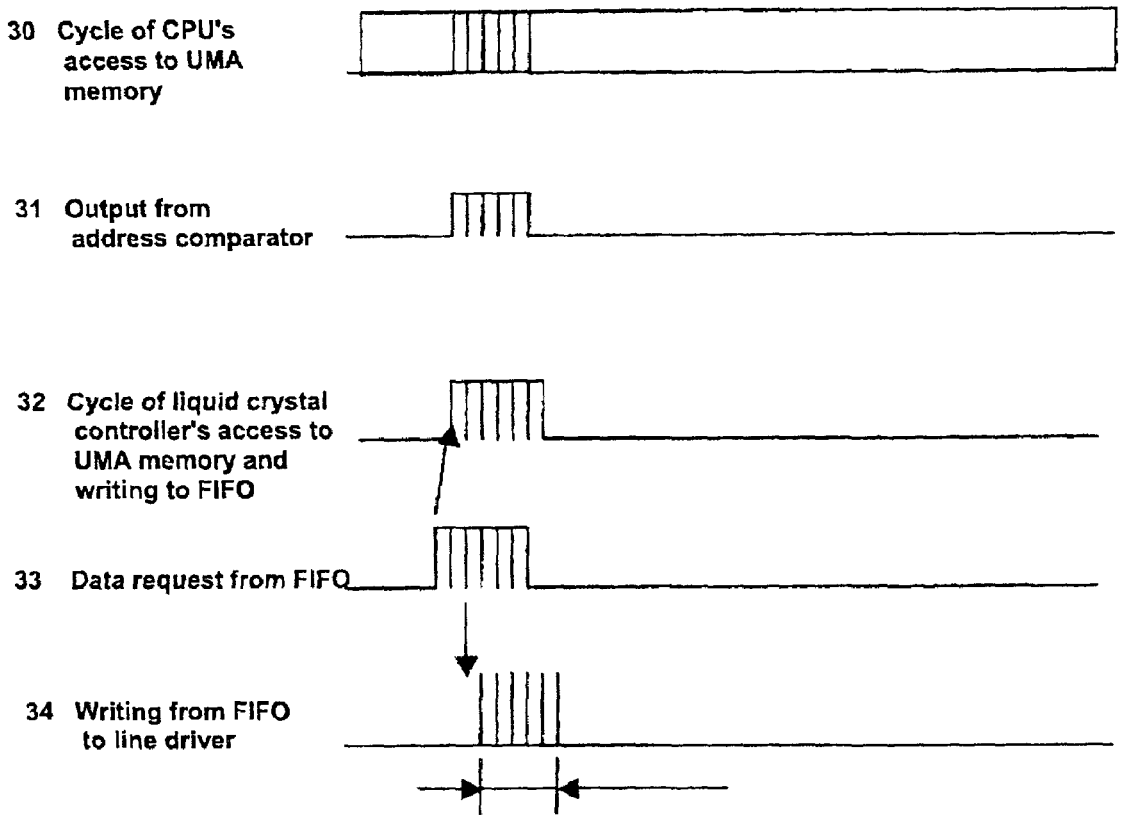
FIG. 8 is a chart indicating access timings to the UMA memory of the liquid crystal display apparatus.

FIG. 8 shows timing charts for describing an operation of the apparatus shown in FIG. 7. When writing by the CPU 1 to the UMA memory 3 occurs, as indicated in a timing chart 30, a signal is outputted from the address comparator 12, as indicated by a timing chart 31. Upon receiving the signal, the liquid crystal controller 5 reads out display data from the UMA memory 3 and writes the same in the FIFO 6, as indicated in a timing chart 32. A timing chart 33 indicates a timing in which the FIFO 6, as it becomes empty, sends a data request to the liquid crystal controller 5. A timing chart 34 indicates a timing in which the FIFO 6 writes display data in the memory 10 mounted on the line driver.

Figure 9:
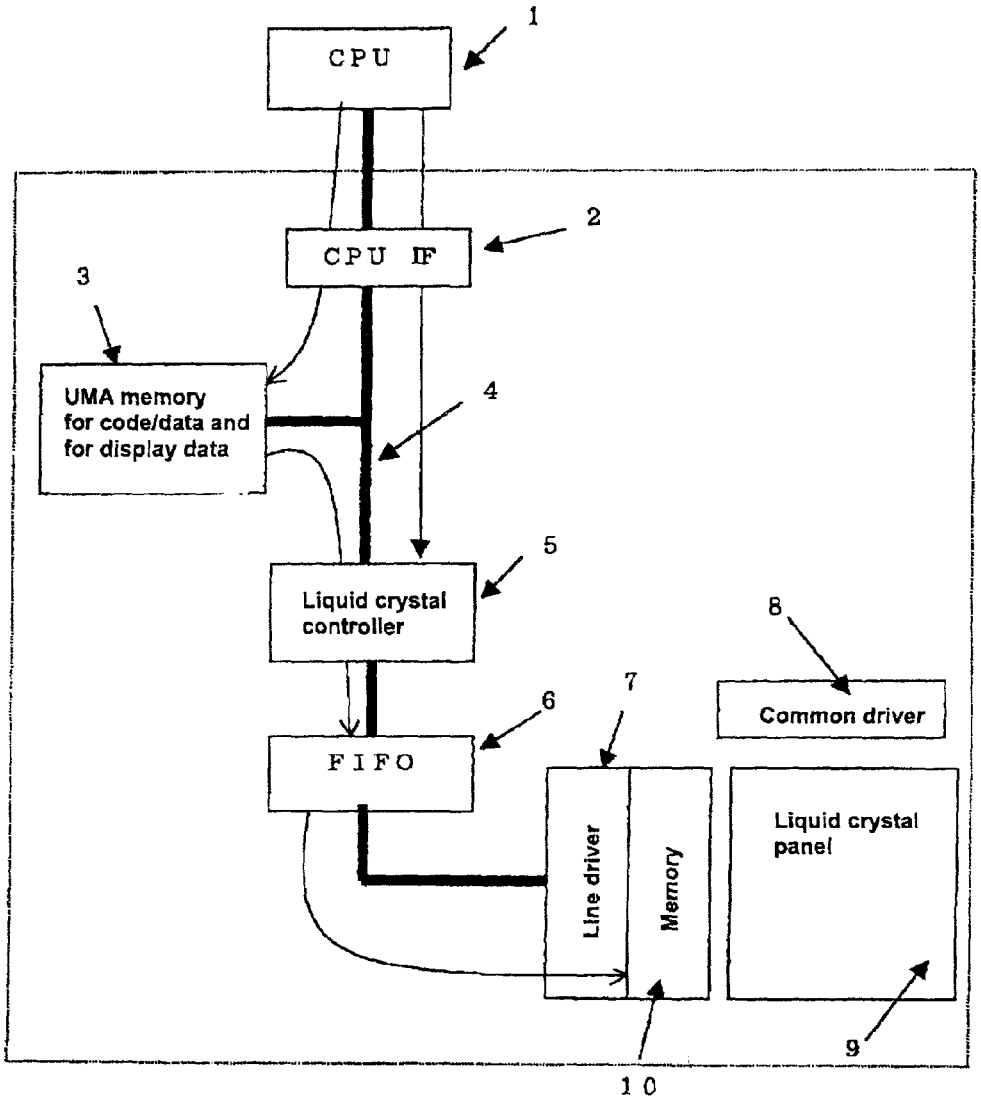
FIG. 9 is a diagram for describing a liquid crystal display apparatus.

FIG. 9 shows a structure of a liquid crystal display apparatus. Its basic structure is similar to that of the apparatus, but is different in that the CPU 1 explicitly instructs the liquid crystal controller 5 to transfer display data. When the software completely or partially completes rewriting of a picture for one frame, an instruction to renew display on the liquid crystal panel becomes possible upon completion of the task. In other words, unless the software instructs a renewal of picture data, the liquid crystal panel 9 can refresh the picture by using display data retained in the memory 10 mounted on the line driver. As a result, the traffic on the memory bus 4 can be substantially reduced.

Figure 10:
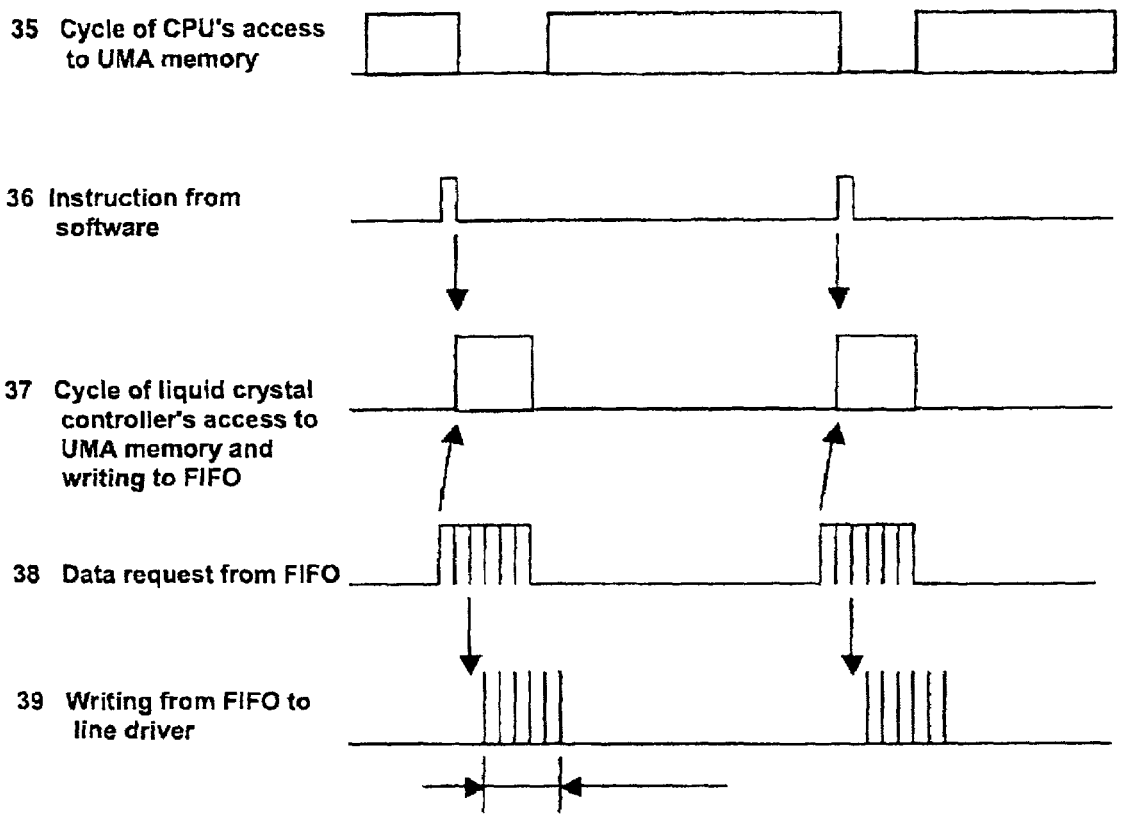
FIG. 10 is a chart indicating access timings to the UMA memory of the liquid crystal display apparatus.

FIG. 10 shows timing charts for describing an operation of the apparatus shown in FIG. 9. When an instruction of the software is generated at the CPU1, the liquid crystal controller 5, upon receiving the signal, reads out display data from the UMA memory 3, and writes the same in the FIFO 6, as indicated in a timing chart 37. A timing chart 38 indicates a timing in which the FIFO 6, as it becomes empty, sends a data request to the liquid crystal controller 5. A timing chart 39 indicates a timing in which the FIFO 6 writes display data in the memory 10 mounted on the line driver.

Figure 11:
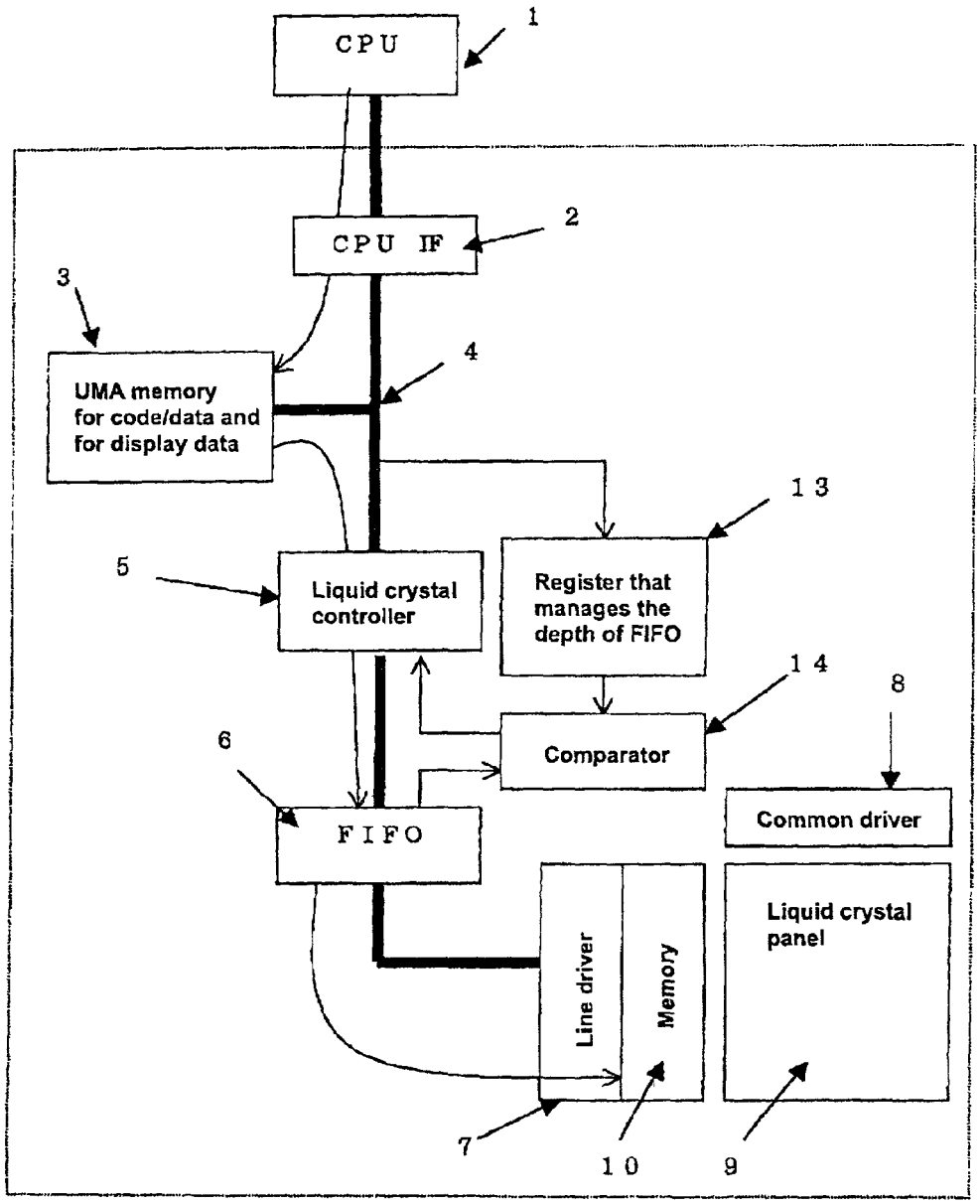
FIG. 11 is a diagram for describing a liquid crystal display apparatus.

FIG. 11 shows a structure of a liquid crystal display apparatus. The FIFO 6 generates a data request when the FIFO 6 becomes empty. However, when the FIFO has a certain depth, for example, 128 words, a data transfer request may be issued at a stage when the FIFO becomes partially empty by a predetermined amount of words, such that the waiting time can be shortened and the transfer efficiency is improved, compared to a case in which new data is transferred only when the FIFO is completely emptied. A register 13 manages the depth of the FIFO in which a data transfer should be started. A comparator 14 compares an empty state of the FIFO 6 with a value retained at the register 13, and instructs the liquid crystal controller 5 to start a data transfer when the empty condition of the FIFO 6 coincides with the retained value.

Figure 12:
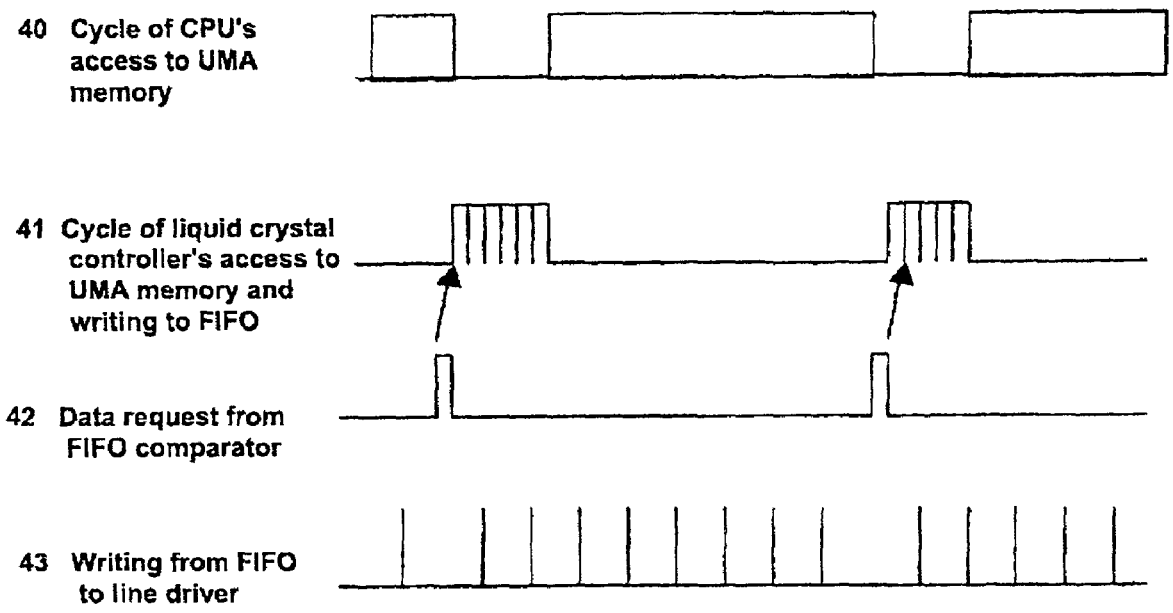
FIG. 12 is a chart indicating access timings to the UMA memory of the liquid crystal display apparatus.

FIG. 12 shows timing charts for describing an operation of the apparatus shown in FIG. 11. The FIFO comparator 14, upon detecting that the empty condition of the FIFO 6 coincides with a programmed value in the register 13, notifies the same to the liquid crystal controller 5, as indicated in a timing chart 42. The liquid crystal controller 5, as indicated in a timing chart 41, reads out display data from the display data region of the UMA memory 3 and writes the same until the FIFO 6 is filled. The FIFO 6 transfers display data en masse to the memory 10 mounted on the line driver, as indicated in a timing chart 43.

Figure 13:
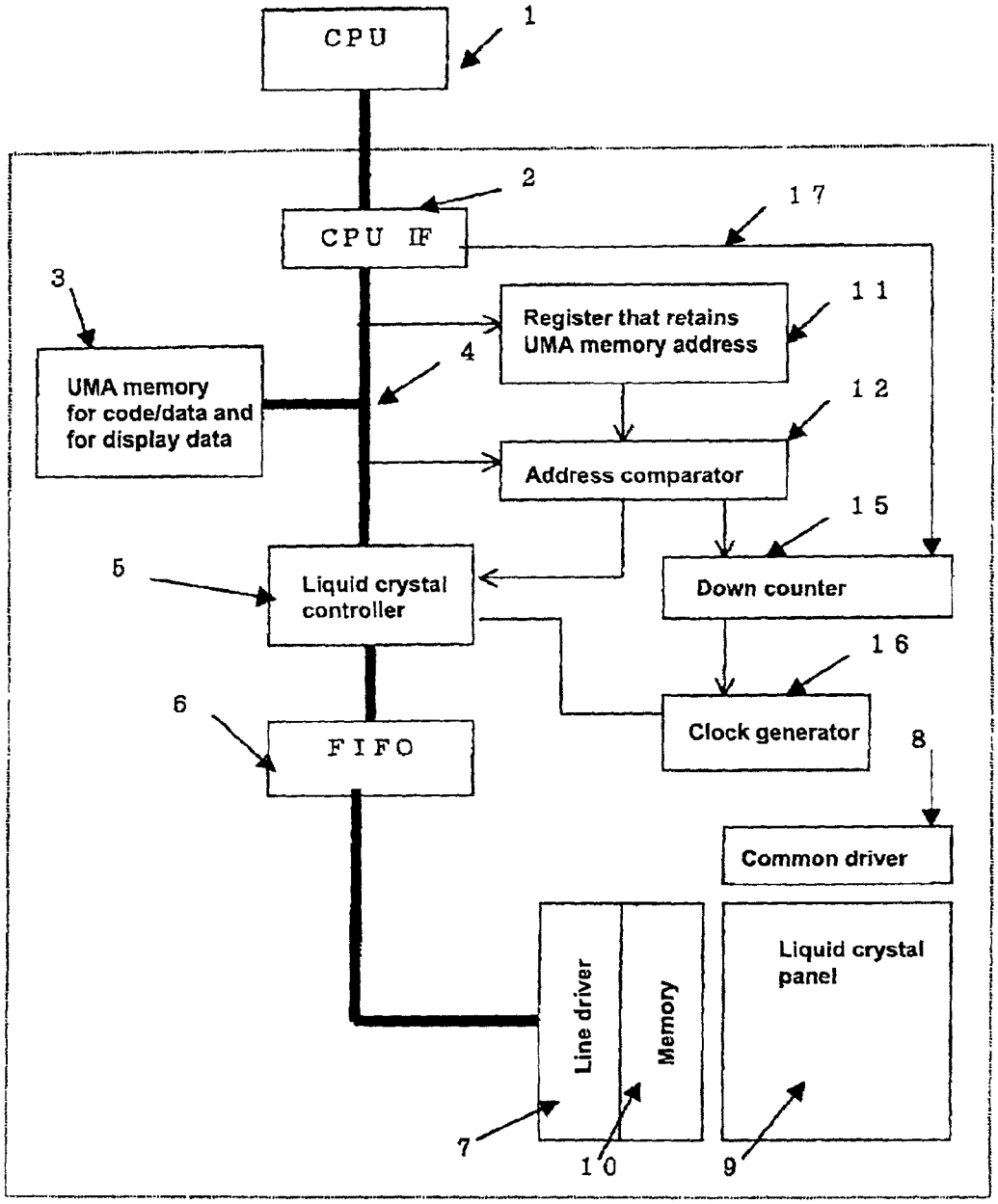
FIG. 13 is a diagram for describing a liquid crystal display apparatus.

FIG. 13 shows a structure of a liquid crystal display. This is provided by adding to the apparatus a down counter 15 and a clock generator 16 that is controllable by an output of the down counter 15. The down counter 15 monitors an output of the address comparator 12, and reaches a value 0 when the output is not observed for a predetermined period of time to thereby stop the output of the clock generator 16. In other words, when there is no writing in a display data region of the UMA memory 3, the CPU 1 or other bus masters stop the operation clock for the display system to thereby reduce power consumption for the display. In this case, since display data is retained at the memory 10 mounted on the line driver, and the liquid crystal panel 9 refreshes the display using the data, the display is not affected at all. The display clock is restarted as the CPU 1 explicitly issues an instruction as indicated by an arrow 17 in the figure to set the down counter at an initial value.

Figure 14:
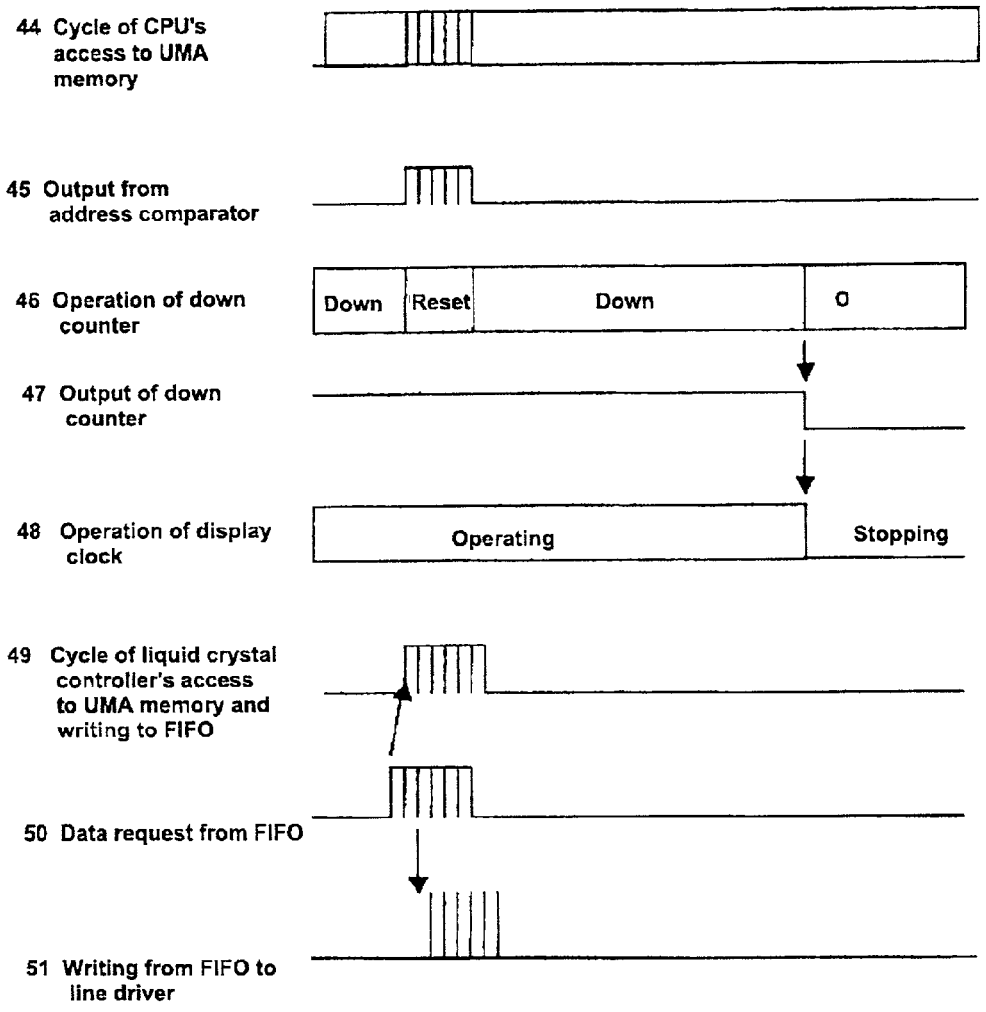
FIG. 14 is a chart indicating an operation of a display clock of the liquid crystal display apparatus.

FIG. 14 shows timing charts for describing an operation of the apparatus shown in FIG. 13. A timing chart 44 indicates that the CPU 1 writes in a display data region of the UMA memory 3, and a timing chart 45 indicates that the address comparator 12 detects the writing. A timing chart 46 indicates that the down counter 15 continues counting until the detection, and the down counter is reset at the detection, also it continues counting and reaches a value of zero when there is no detection. When the value of the down counter 15 becomes zero, the output of the down counter 15 changes in a manner indicated in a timing chart 47, and the display clock stops as indicated in a timing chart 48.

Figure 15:
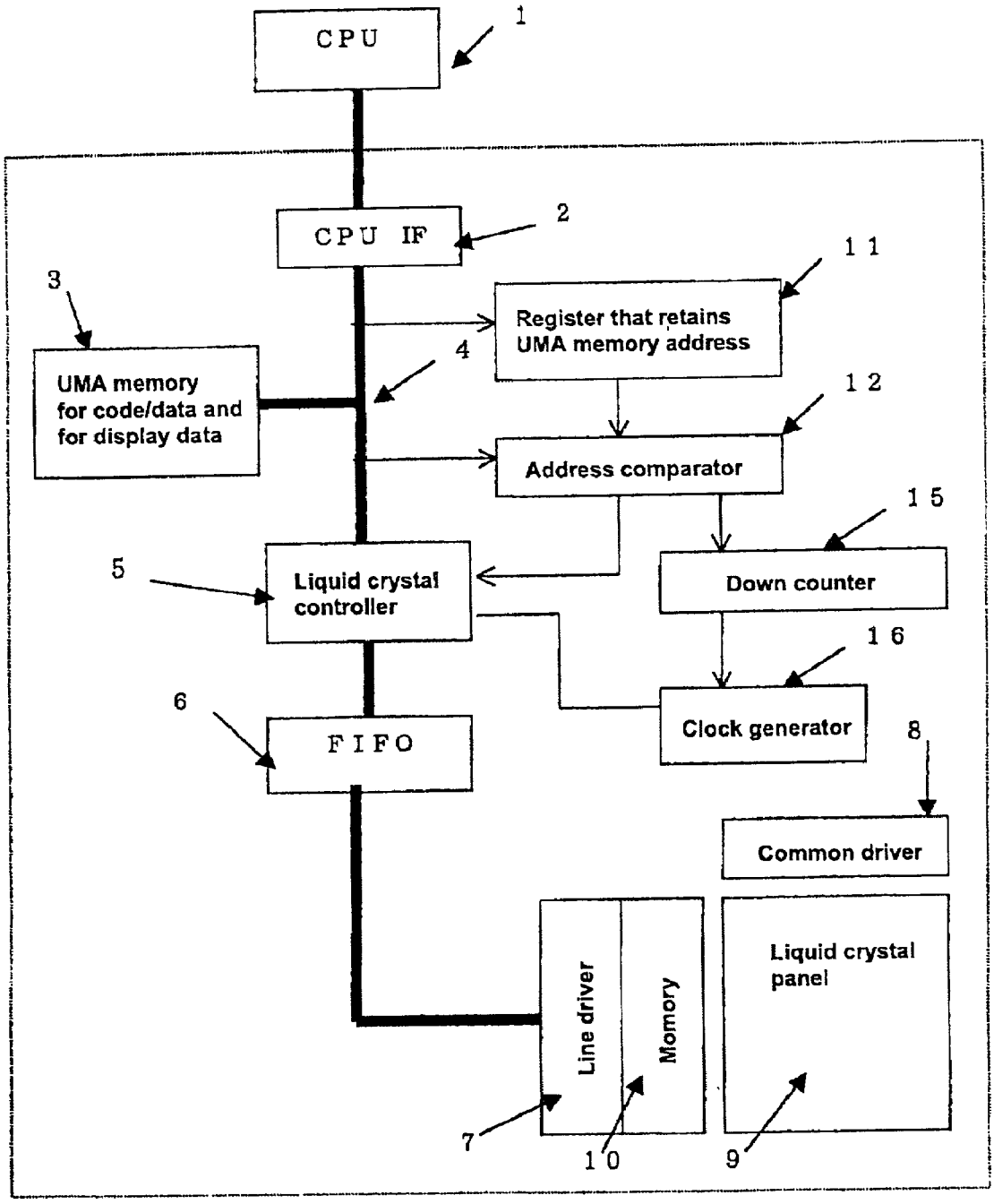
FIG. 15 is a diagram for describing a liquid crystal display apparatus.
Figure 16:
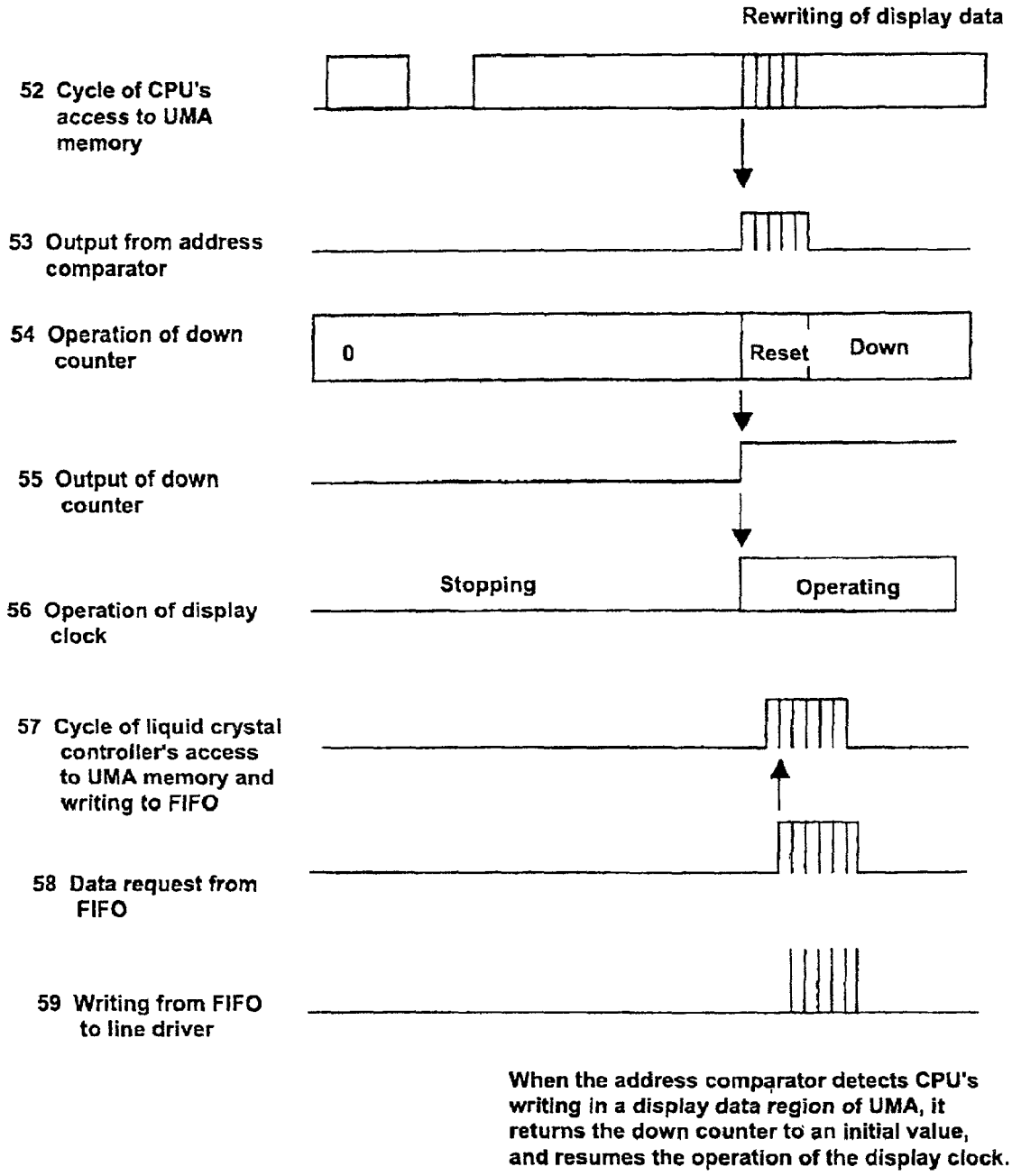
FIG. 16 is a chart indicating an operation of a display clock of the liquid crystal display apparatus.

FIG. 15 shows a structure of a liquid crystal display apparatus, wherein a device that resumes the clock generator 16 is different. Referring to FIG. 16, its operation is described. As indicated in a timing chart 54, the down counter 15 is in a state of stopping. As indicated in a timing chart 52, when the CPU 1 writes in a display data region of the UMA memory 3, the address comparator 12 outputs an output signal, as indicated in a timing chart 53, the down counter 15 returns to its initial value upon receiving the signal, and removes the stop signal that has been outputted to the clock generator 16. This operation does not require an explicit instruction from the CPU 1.

Figure 17:
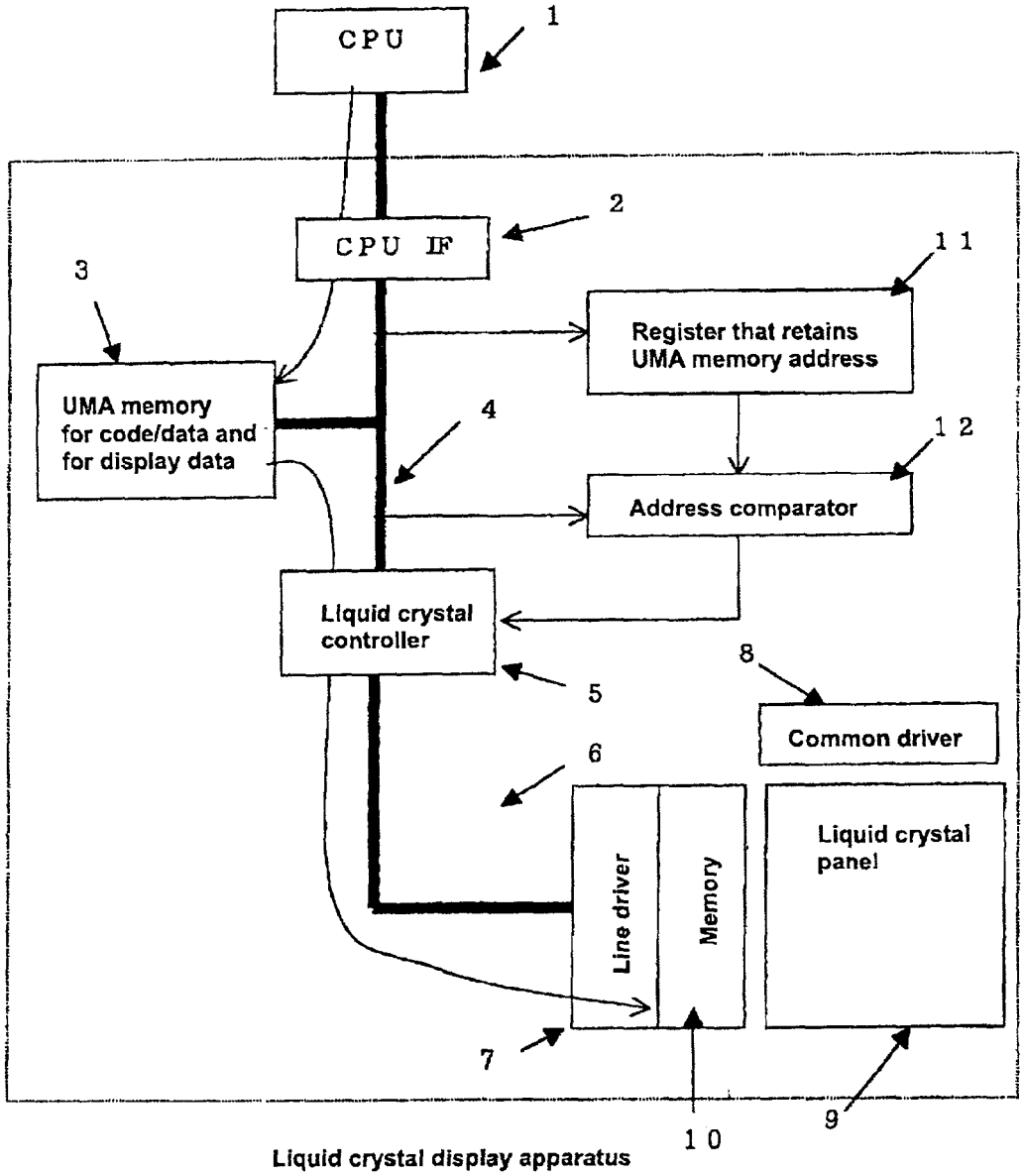
FIG. 17 is a diagram for describing a liquid crystal display apparatus.
Figure 18:
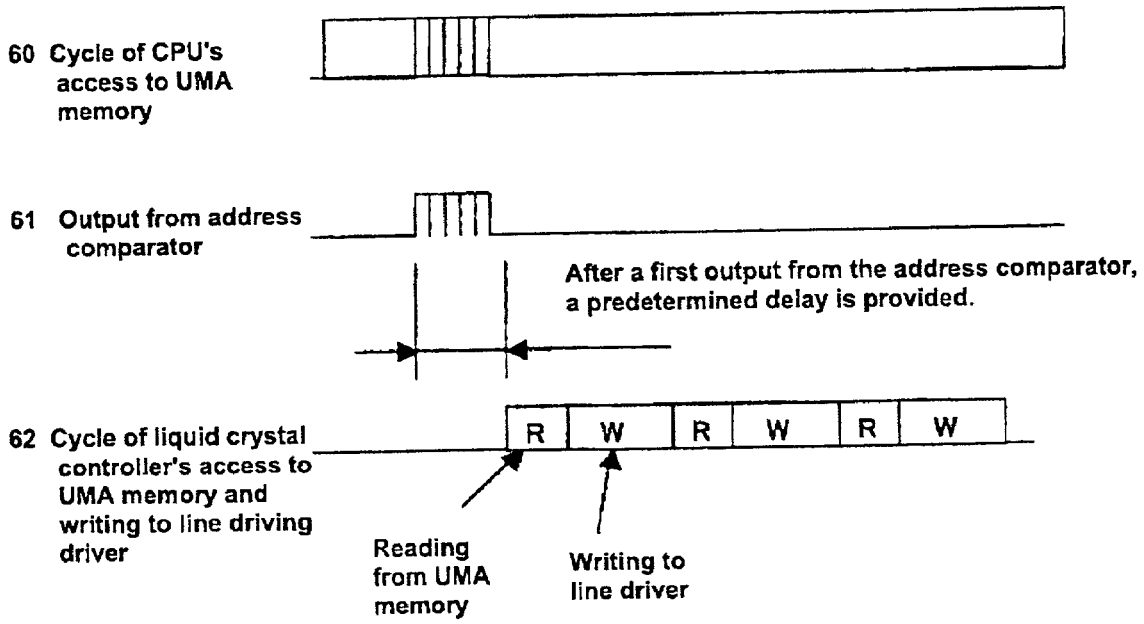
FIG. 18 is a chart indicating access timings to the UMA memory of the liquid crystal display apparatus.

FIG. 17 shows a structure of a liquid crystal display apparatus. Although the present invention has the same basic structure as that of the apparatus, it does not have a FIFO. Referring to FIG. 18, its operation is described. A timing chart 60 indicates a timing in which the CPU 1 writes in a display data region of the UMA memory 3, and a timing chart 61 indicates that the address comparator 12 detects the writing. After a predetermined period of time elapses after the detection, the liquid crystal controller 5 alternately performs reading from the UMA memory 3 and writing in the memory 10 mounted on the line driver, to thereby transfer display data for one frame.

In this manner, while the liquid crystal display apparatus in accordance with the present invention adopts a UMA memory, it can inhibit the reduction of the bandwidth of UMA memory access by the CPU without affecting the liquid crystal display, and also is capable of contributing to the reduction of power consumption associated with the display.

The entire disclosure of Japanese Patent Application No. 2001-120222 filed Apr. 18, 2001 is incorporated by reference herein.

The invention claimed is:

1. A liquid crystal display apparatus comprising:

a liquid crystal display panel including a common driver and a line driver;

a liquid crystal display controller which includes a FIFO for storing display data for the liquid crystal display panel, the FIFO having a capacity of a plurality of words;

a UMA memory for storing executable code and data used for an operation by a central processing unit and for storing a display data for the liquid crystal display controller, the UMA memory including a predetermined image-display memory area for storing display data;

an interface means with the central processing unit; and a detection device including an address comparator that detects whether the display data in the image-display memory area in the UMA memory is updated by comparing a memory rewrite address of a memory rewrite instruction with an image-display area address of the UMA memory, the image-display area address corresponding to the predetermined image-display memory area;

wherein the line driver includes a display-data storage memory so as to allow the liquid crystal display panel to refresh with display data;

the detection device sends a signal to the liquid crystal display controller when the detection device detects that the display data in the image-display memory area in the UMA memory is updated;

when receiving the signal from the detection device, the liquid crystal display controller obtains the display data from the UMA memory and writes the display data into the FIFO; and wherein the liquid crystal display controller sends the display data from the FIFO when the liquid crystal display panel requires the display data.

2. The liquid crystal display apparatus according to claim 1 further comprising:

a clock generator; and a down counter which is capable of controlling the clock generator, wherein the down counter monitors whether the detection device has detected that the display data in the image-display memory area of the UMA memory is updated and has sent a signal to the liquid crystal display controller, and when the signal is not sent for a predetermined period, the down counter stops an output from the clock generator so as to reduce power consumption for the display.

3. The liquid crystal display apparatus according to claim 2, wherein when the down counter detects that the signal has been sent from the detection device to the liquid crystal display controller after stopping the output from the clock generator, the down counter restarts the output from the clock generator and restarts monitoring if the signal has been sent from the detection device to the liquid crystal display controller within the predetermined period.

4. The liquid crystal display apparatus according to claim 3, when receiving an instruction to restart the output from the clock generator from the central processing unit after stopping the output from the clock generator, the down counter restarts the output from the clock generator and monitors whether the signal has been sent from the detection device to the liquid crystal display controller within the predetermined period.

5. A liquid crystal display apparatus comprising:

a liquid crystal display panel including a common driver and a line driver;

a liquid crystal display controller which includes a FIFO for storing display data for the liquid crystal display panel, the FIFO having a capacity of a plurality of words;

a UMA memory for storing executable code and data used for an operation by a central processing unit and for storing display data for the liquid crystal display controller, the UMA memory including a predetermined image-display memory area for storing display data;

an interface means with the central processing unit, wherein the line driver includes a display-data storage memory so as to allow the liquid crystal display panel to refresh the display data;

the central processing unit monitors a memory rewrite address of a memory rewrite instruction and instructs the liquid crystal display controller to update the display of the liquid crystal display panel when the memory rewrite address of the memory rewrite instruction is within the image-display memory area of the UMA memory; and wherein in response to an instruction to update the display of the liquid crystal display panel from the central processing unit, the liquid crystal display controller obtains the display data from the UMA memory and writes the display data into the FIFO.

6. A liquid crystal display apparatus comprising:

a liquid crystal display panel including a common driver and a line driver;

a liquid crystal display controller which includes a FIFO for storing display data for the liquid crystal display panel, the FIFO having a capacity of a plurality of words;

a UMA memory for storing executable code and data used for an operation by a central processing unit and for storing a display data for the liquid crystal display controller, the UMA memory including a predetermined image-display memory area for storing display data;

an interface means with the central processing unit, a register for storing a threshold of the FIFO that allows data to be transferred;

a detection device including an address comparator that detects whether the display data in the image-display memory area in the UMA memory is updated by comparing a memory rewrite address of a memory rewrite instruction with an image-display area address of the UMA memory and that sends a signal to the liquid crystal display controller when the display data set is updated, the image-display area address corresponding to the predetermined image-display memory area; and a comparator for monitoring an empty state of the FIFO and for providing instruction to the liquid crystal display controller to start transferring the data when the space of the FIFO coincides with the threshold stored in the register, wherein the line driver includes a display-data storage memory so as to allow the liquid crystal display panel to refresh the display data;

when receiving an instruction to start transferring the data from the comparator, and when receiving the signal from the detection device, the liquid crystal display controller obtains the display data from the UMA memory and writes the display data into the FIFO until the FIFO becomes full; and the liquid crystal display controller sends the display data from the FIFO to the display-data storage memory provided for the line driver.

7. A liquid crystal display apparatus comprising:

a liquid crystal display panel including a common driver and a line driver;

a liquid crystal display controller which includes a FIFO for storing display data for the liquid crystal display panel, the FIFO having a capacity of a plurality of words;

a UMA memory for storing executable code and data used for an operation by a central processing unit and for storing a display data for the liquid crystal display controller, the UMA memory including a predetermined image-display memory area for storing display data;

an interface means with the central processing unit; and a detection device including an address comparator that detects whether the display data in the image-display memory area in the UMA memory is updated by comparing a memory rewrite address of a memory rewrite instruction with an image-display area address of the UMA memory, the image-display area address corresponding to the predetermined image-display memory area;

wherein the line driver includes a display-data storage memory so as to allow the liquid crystal display panel to refresh the display data;

the detection device sends a signal to the liquid crystal display controller when the detection device detects that the display data set in the image-display memory area in the UMA memory is updated;

when receiving the signal from the detection device, after the lapse of a predetermined period, the liquid crystal display controller alternately reads the display data from the UMA memory and writes the display data into the display-data storage memory provided for the line driver so as to send the display data for one frame to the liquid crystal display panel.

8. A driver for a liquid crystal display panel comprising:

a liquid crystal display controller which includes a FIFO for storing display data for the liquid crystal display panel, the FIFO having a capacity of a plurality of words;

a UMA memory for storing executable code and data used for an operation by a central processing unit and for storing a display data for the liquid crystal display controller, the UMA memory including a predetermined image-display memory area for storing display data;

an interface circuit with a central processing unit;

wherein the central processing unit monitors a memory rewrite address of a memory rewrite instruction and instructs the liquid crystal display controller to update the display of the liquid crystal display panel when the memory rewrite address of the memory rewrite instruction is within the image-display memory area of the UMA memory; and wherein in response to an instruction to update the display of the liquid crystal display panel from the central processing unit, the liquid crystal display controller obtains the display data from the UMA memory and writes the display data in to the FIFO.

9. A driver for a liquid crystal display panel comprising:

a liquid crystal display controller which includes a FIFO for storing display data for the liquid crystal display panel, the FIFO having a capacity of a plurality of words;

a UMA memory for storing executable code and data used for an operation by a central processing unit and for storing a display data set for the liquid crystal display controller, the UMA memory including a predetermined image-display memory area for storing display data;

an interface circuit with the central processing unit, a register for storing a threshold of the FIFO that allows data to be transferred;

a comparator for monitoring an empty state of the FIFO and for providing an instruction to the liquid crystal display controller to start transferring the data when the space of the FIFO coincides with the threshold stored in the register, and a detection device including an address comparator that detects whether the display data in the image-display memory area in the UMA memory is updated by comparing a memory rewrite address of a memory rewrite instruction with an image-display area address of the UMA memory and that sends a signal to the liquid crystal display controller when the display data set is updated, the image-display area address corresponding to the predetermined image-display memory area;

wherein when receiving an instruction to start transferring the data from the comparator, and when receiving the signal from the detection device, the liquid crystal display controller obtains the display data from the UMA memory and writes the display data into the FIFO until the FIFO becomes full; and the liquid crystal display controller sends the display data from the FIFO to the display-data storage memory provided for the liquid crystal display panel.

10. The driver for a liquid crystal display panel according to claim 9 further comprising:

a clock generator; and a down counter which is capable of controlling the clock generator, wherein the down counter monitors whether the detection device has detected that the display data in the image-display memory area of the UMA memory is updated and has sent a signal to the liquid crystal display controller, and when the signal is not sent for a predetermined period, the down counter stops an output from the clock generator so as to reduce power consumption for the display.

11. The driver for a liquid crystal display panel according to claim 10, wherein when the down counter detects that the signal has been sent from the detection device to the liquid crystal display controller after stopping the output from the clock generator, the down counter restarts the output from the clock generator and restarts monitoring if the signal has been sent from the detection device to the liquid crystal display controller within the predetermined period.

12. The driver for a liquid crystal display panel according to claim 11, when receiving an instruction to restart the output from the clock generator from the central processing unit after stopping the output from the clock generator, the down counter restarts the output from the clock generator and monitors whether the signal has been sent from the detection device to the liquid crystal display controller within the predetermined period.

13. A driver for a liquid crystal display panel comprising:

a liquid crystal display controller;

a UMA memory for storing executable code and data used for an operation by a central processing unit and for storing a display data for the liquid crystal display controller, the UMA memory including a predetermined image-display memory area for storing display data;

an interface with the central processing unit; and a detection device including an address comparator that detects whether the display data in the image-display memory in the UMA memory is updated by comparing a memory rewrite address of a memory rewrite instruction with an image-display area address of the UMA memory, the image-display area address corresponding to the image-display memory area;

the detection device sending a signal to the liquid crystal display controller when the detection device detects that the display data in the image-display memory area in the UMA memory is updated;

wherein when receiving the signal from the detection device, after the lapse of a predetermined period, the liquid crystal display controller alternately reads the display data from the UMA memory and writes the display data into a display-data storage memory provided for the liquid crystal display panel so as to send the display data set for one frame to the liquid crystal display panel for display.

* * * * *